US006915730B2

(12) United States Patent
Cherney

(10) Patent No.: US 6,915,730 B2
(45) Date of Patent: Jul. 12, 2005

(54) SPOOL-TYPE HYDRAULIC DIRECTIONAL CONTROL VALVE HAVING REDUCED CAVITATION

(75) Inventor: Mark John Cherney, Potosi, WI (US)

(73) Assignee: Deere & Company, Moline, IL (US)

( * ) Notice: Subject to any disclaimer, the term of this patent is extended or adjusted under 35 U.S.C. 154(b) by 6 days.

(21) Appl. No.: 10/645,967

(22) Filed: Aug. 22, 2003

(65) Prior Publication Data

US 2005/0039805 A1 Feb. 24, 2005

(51) Int. Cl.[7] ..... F15B 13/04
(52) U.S. Cl. ..... 91/464; 137/625.69
(58) Field of Search ..... 91/464; 137/625.69

(56) References Cited

U.S. PATENT DOCUMENTS

| | | | | |
|---|---|---|---|---|
| 3,698,434 | A | 10/1972 | Nelson | 137/624.27 |
| 4,129,987 | A | 12/1978 | Blume | 60/445 |
| 4,154,262 | A | 5/1979 | Blume et al. | 137/624.27 |
| 5,251,705 | A | 10/1993 | Waggoner et al. | 172/812 |
| 5,305,789 | A | 4/1994 | Rivolier | 137/596 |
| 5,996,623 | A | 12/1999 | Omberg | 137/596.13 |
| 6,293,181 | B1 | 9/2001 | Hajek, Jr. et al. | 91/464 |
| 6,405,529 | B1 | 6/2002 | Berg et al. | 60/422 |

OTHER PUBLICATIONS

Caterpillar "Specifications for D6H Tractor Hydraulics"; 10 pgs, date unknown.
Dresser Parts Manual; 8 pgs; Jun. 1988.
Fiat Allis Service Manual FD14E Crawler Tractor 5 pgs, date unknown.

*Primary Examiner*—Gerald A. Michalsky

(57) ABSTRACT

A spool-type hydraulic directional control valve having improvements to reduce cavitation when the spool is in the float position. The flow area of a first passageway on the valve spool is appropriately sized to reduce the flow hydraulic fluid flow from the head end of the hydraulic cylinder to the hydraulic fluid reservoir, such that a sufficient proportion of that hydraulic fluid instead flows internally through control valve and back to the rod end of the hydraulic cylinder to reduce cavitation when the valve spool is in the "float" position. Additionally, a second passageway on the valve spool may be blocked-off, eliminating the hydraulic fluid flow path from the hydraulic fluid reservoir to the rod end of the hydraulic cylinder when the valve spool is in the "float" position.

5 Claims, 6 Drawing Sheets

SPOOL-TYPE HYDRAULIC DIRECTIONAL CONTROL VALVE HAVING REDUCED CAVITATION

FIELD OF THE INVENTION

The present invention is directed to a spool-type hydraulic directional control valve having improvements to reduce cavitation when the spool is in the float position

BACKGROUND OF THE INVENTION

Hydraulic circuits are well known and utilized in a wide variety of machines to articulate linkages and turn motors. A typical hydraulic circuit comprises a hydraulic pump, a spool-type control valve, a double acting hydraulic cylinder, and a hydraulic fluid reservoir. The hydraulic pump draws hydraulic fluid from the reservoir and supplies the fluid to the control valve. The control valve manages the flow of hydraulic fluid from the hydraulic pump to the hydraulic cylinder, and between the hydraulic cylinder and the hydraulic fluid reservoir.

When hydraulic fluid is allowed to flow freely between the hydraulic cylinder and the hydraulic fluid reservoir, the hydraulic cylinder is able to move, or float, in response to external forces acting on it. A float condition may be used in certain situations to conserve energy when lowering a load, exploiting the weight of the linkage to move the hydraulic cylinder, rather than consuming energy to pump hydraulic fluid. During this process, the hydraulic cylinder may be caused to move so rapidly that hydraulic fluid in the hydraulic cylinder cavitates. When this occurs, the rate of hydraulic cylinder movement may become erratic. The resulting erratic movement of load which the hydraulic cylinder supports is undesirable.

A more complete description of the prior art hydraulic circuit illustrated in FIGS. 1–4 is presented in the Detailed Description section of this application.

SUMMARY OF THE INVENTION

The present invention improves upon a typical hydraulic circuit to reduce the occurrence of cavitation during the float condition. More specifically, the present invention improves upon the valve spool of a typical spool-type control valve.

In a first embodiment of the present invention, the flow area of a first passageway on the valve spool is appropriately sized to reduce the flow of hydraulic fluid from the head end of the hydraulic cylinder to the hydraulic fluid reservoir, such that a sufficient proportion of that hydraulic fluid instead flows internally through control valve and back to the rod end of the hydraulic cylinder to reduce cavitation when the valve spool is in the "float" position.

In a second embodiment of the present invention, a second passageway on the valve spool is removed, eliminating the hydraulic fluid flow path from the hydraulic fluid reservoir to the rod end of the hydraulic cylinder when the valve spool is in the "float" position. Additionally, the flow area of the first passageway on the valve spool is appropriately sized to reduce the flow hydraulic fluid flow from the head end of the hydraulic cylinder to the hydraulic fluid reservoir, such that a sufficient proportion of that hydraulic fluid instead flows internally through control valve and back to the rod end of the hydraulic cylinder with minimal cavitation when the valve spool is in the "float" position.

DETAILED DESCRIPTION

Figure 1:
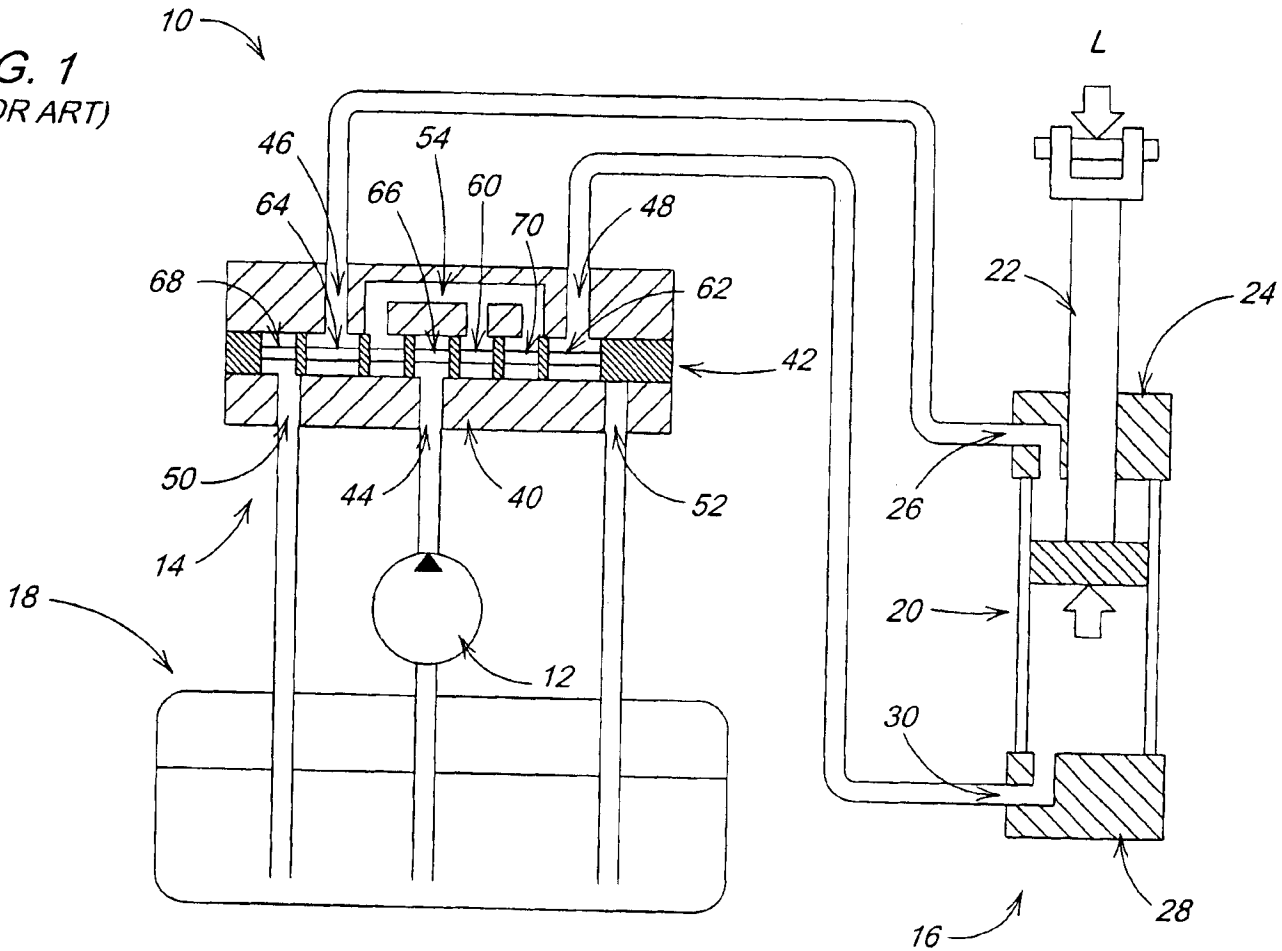
FIG. 1 (PRIOR ART)
FIG. 1 is a schematic representation of a prior art hydraulic circuit with a double-acting hydraulic cylinder and a spool-type hydraulic control valve typical of the prior art. The circuit is shown in "neutral" condition wherein the hydraulic cylinder is held in a static position against an external load by the hydraulic circuit.

Hydraulic circuits are well known and utilized in a wide variety of machines to articulate linkages and turn motors. FIG. 1 illustrates a typical hydraulic circuit 10 suitable for manipulating a linkage. The hydraulic circuit 10 comprises a hydraulic pump 12, a spool-type control valve 14, a double acting hydraulic cylinder 16, and a hydraulic fluid reservoir 18. The hydraulic pump 12 draws hydraulic fluid from the reservoir 18 and supplies the fluid to the control valve 14. The control valve 14 directs the flow of hydraulic fluid from the hydraulic pump 12 to the hydraulic cylinder 16, and between the hydraulic cylinder 16 and the hydraulic fluid reservoir 18.

The hydraulic cylinder 16 illustrated in FIG. 1 comprises a cylinder body 20 and a cylinder rod 22. The cylinder body 20 has a rod end 24 with a rod end port 26, and a head end 28 with a head end port 30. The cylinder rod 22 variably extends from the rod end 24 of the cylinder body 20, and translates in response to the flow of hydraulic fluid between the control valve 14 and the hydraulic cylinder 16. For illustration purposes, the hydraulic cylinder 16 is represented in a configuration where a load L is lifted against gravity when the hydraulic cylinder 16 is extended.

When hydraulic fluid is supplied to the head end port 30, and hydraulic fluid is allowed to escape from the rod end port 26, the cylinder rod 22 extends outwardly from the cylinder body 20 until hydraulic flow is discontinued, or until the travel limit of cylinder rod 22 is reached. Conversely, when hydraulic fluid is supplied to the rod end port 26, and hydraulic fluid is allowed to escape from the head end port 30, the cylinder rod 22 contracts inward towards the cylinder body 20 until hydraulic flow is discontinued, or until the travel limit of cylinder rod is reached.

When hydraulic fluid flow is closed-off at both of the head end port 30 and the rod end port 26, the position of the cylinder rod 22 remains static relative to the cylinder body 20. Alternatively, when hydraulic fluid is allowed to flow freely at both of the head end port 30 and the rod end port 26, the cylinder rod 22 is able to move, or float, relative to the cylinder body 20 in response to external forces acting on the hydraulic cylinder 16. A float condition is commonly used applications where it is desirable for a linkage manipulated by the hydraulic cylinder 16 to be allowed to float over terrain. Alternately, a float condition may be utilized to conserve energy when lowering a load L, exploiting the weight of the linkage to compress the cylinder rod 22 towards the cylinder body 20 rather than consuming energy to pump hydraulic fluid. Examples of such applications include loaders and farm implements.

The control valve 14 illustrated in FIG. 1 comprises a valve body 40 and a valve spool 42. The valve body 40 has a supply port 44, a first work port 46, a second work port 48, and first return port 50, a second return port 52, and a supply passage 54. In the illustrated system, the supply port 44 is fluidly connected to the hydraulic pump 12, the first work port 46 is fluidly connected to the rod end port 26 of the hydraulic cylinder 16, and the second work port 48 is fluidly connected to the head end port 30 of the hydraulic cylinder 16. Both the first return port 50 and the second return port 52 are fluidly connected to the hydraulic fluid reservoir 18.

The valve spool 42 illustrated in FIG. 1 comprises a rod with a plurality of flow passages that variably extends within the valve body 40. The position of valve spool 42 relative to the valve body 40 determines the flow of hydraulic fluid within the control valve 14. The position of the spool 42 may be controlled either manually by an operator, or automatically by a mechanical or electronic control system. When the valve spool 42 is the "neutral" position as shown in FIG. 1, hydraulic fluid flow is closed-off at all valve ports. Hydraulic fluid flow is thereby closed-off at both of the head end port 30 and the rod end port 26, and the position of the cylinder rod 22 remains static relative to the cylinder body 20.

Figure 2:
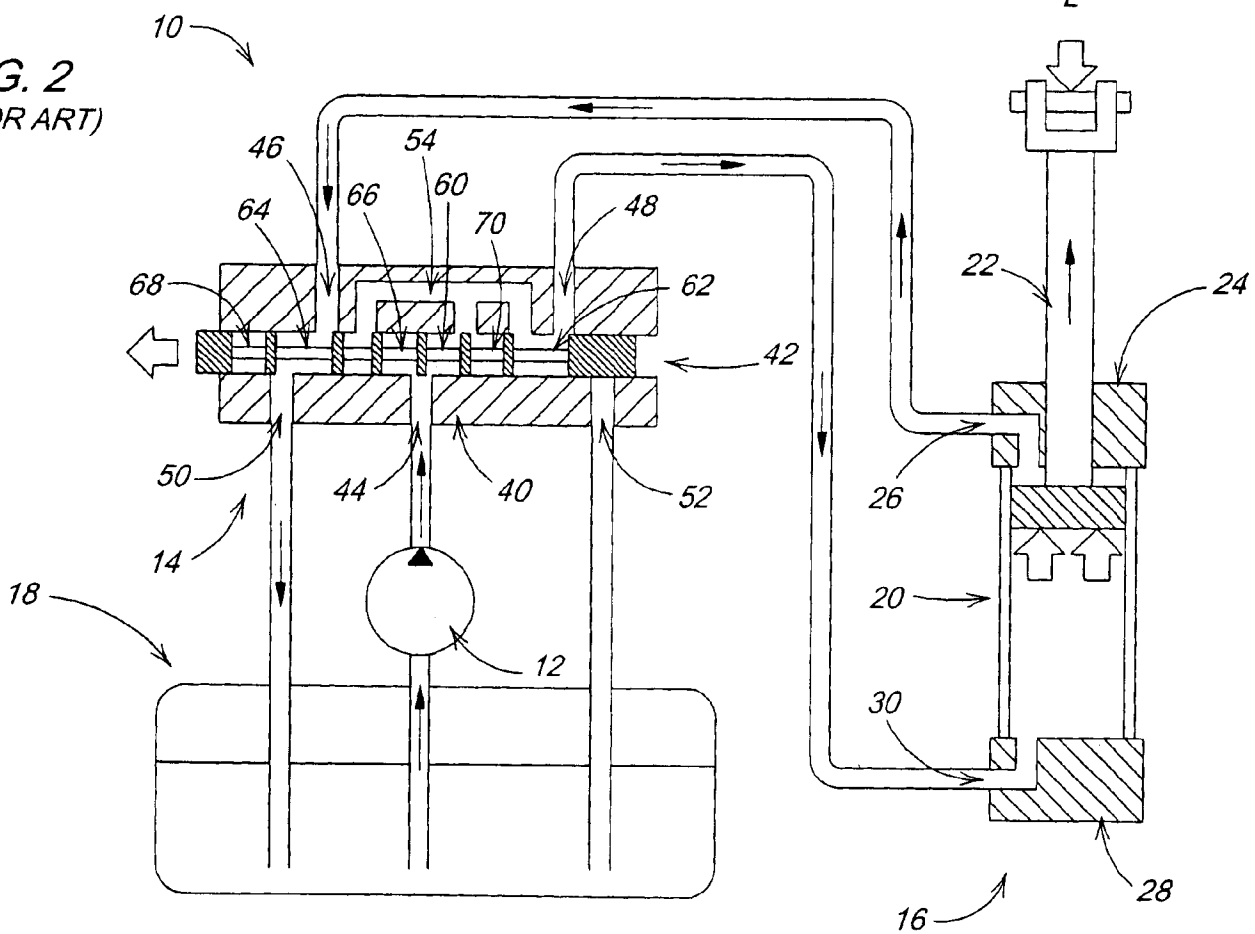
FIG. 2 (PRIOR ART)
FIG. 2 is the schematic representation of the circuit shown in FIG. 1, the circuit shown during a "raise" function wherein the hydraulic cylinder is being extended against an external load by the hydraulic circuit.

When the valve spool 42 is moved left from the "neutral" position to the "raise" position, as shown in FIG. 2, a fifth passageway 60 on the valve spool 42 allows hydraulic fluid to flow from the hydraulic pump 12 to the supply passage 54, while simultaneously, a first passageway 62 on the valve spool 42 allows hydraulic fluid to flow from the supply passage 54 to the second work port 48, creating a flow path for the hydraulic pump 12 to supply hydraulic fluid to the head end port 30 of the hydraulic cylinder 16. A third passageway 64 on the valve spool 42 allows hydraulic fluid to flow from the first work port 46 to the first return port 50, creating a flow path for hydraulic fluid to escape from the rod end port 26 of the hydraulic cylinder 16 and back to the hydraulic fluid reservoir 18. The cylinder rod 22 is thereby caused to extend outwardly from the cylinder body 20 until hydraulic flow is discontinued, or until the travel limit of cylinder rod 22 is reached.

Figure 3:
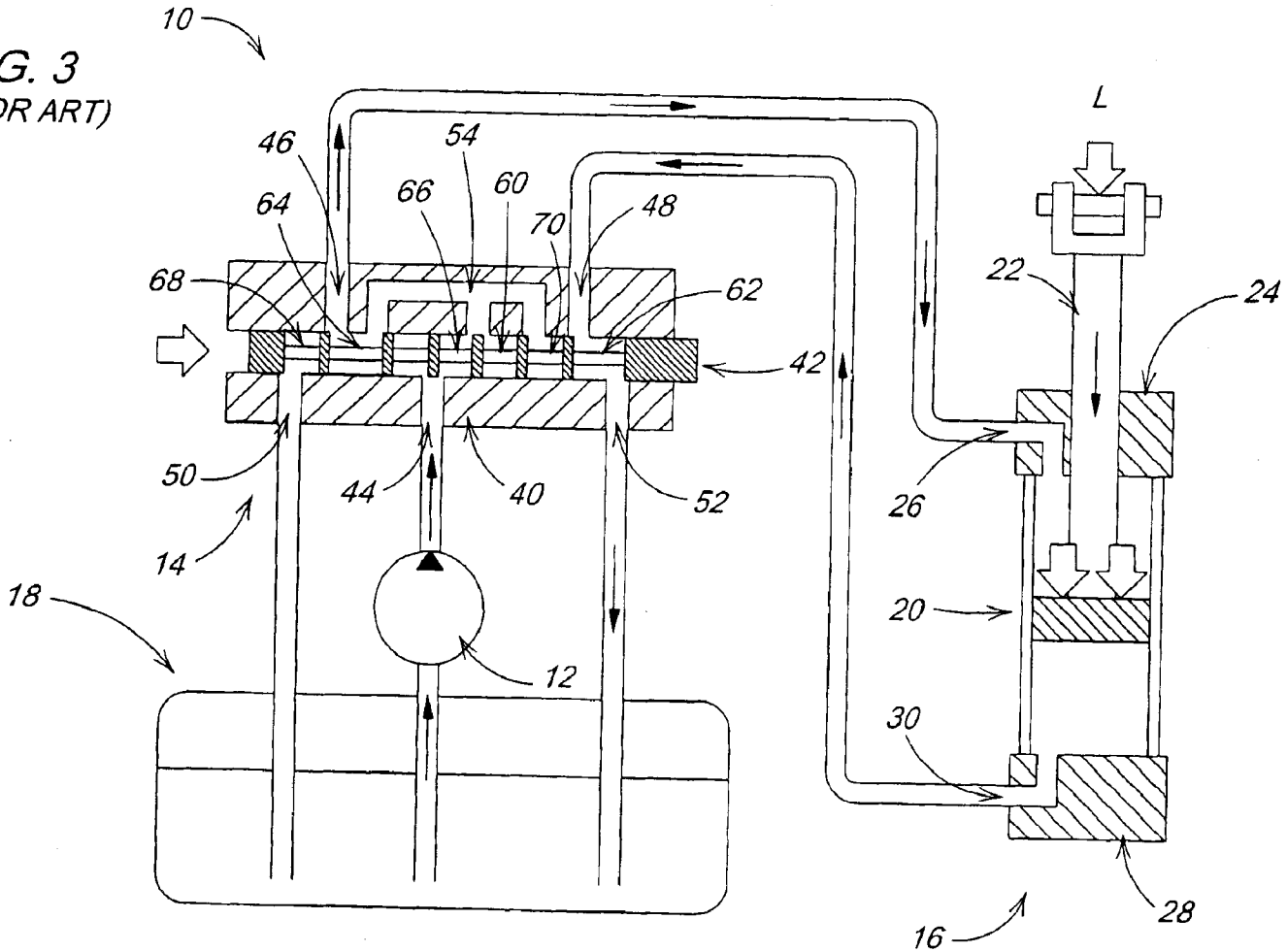
FIG. 3 (PRIOR ART)
FIG. 3 is the schematic representation of the circuit shown in FIG. 1, the circuit shown during a "lower" function wherein the hydraulic cylinder is being contracted against an external load by the hydraulic circuit.

Conversely, when the valve spool 42 is moved right from the "neutral" position to the "lower" position, as shown in FIG. 3, a fourth passageway 66 on the valve spool 42 allows hydraulic fluid to flow from the hydraulic pump 12 to the supply passage 54, while simultaneously, the third passageway 64 on the valve spool 42 allows hydraulic fluid to flow from the supply passage 54 to the first work port 46, creating a flow path for the hydraulic pump 12 to supply hydraulic fluid to the rod end port 26 of the hydraulic cylinder 16. The first passageway 62 on the valve spool 42 allows hydraulic fluid to flow from the second work port 48 to the second return port 52, creating a flow path for hydraulic fluid to escape from the head end port 30 of the hydraulic cylinder 16 and back to the hydraulic fluid reservoir 18. The cylinder rod 22 is thereby caused to retract inwardly towards the cylinder body 20 until hydraulic flow is discontinued, or until the travel limit of cylinder rod 22 is reached.

Figure 4:
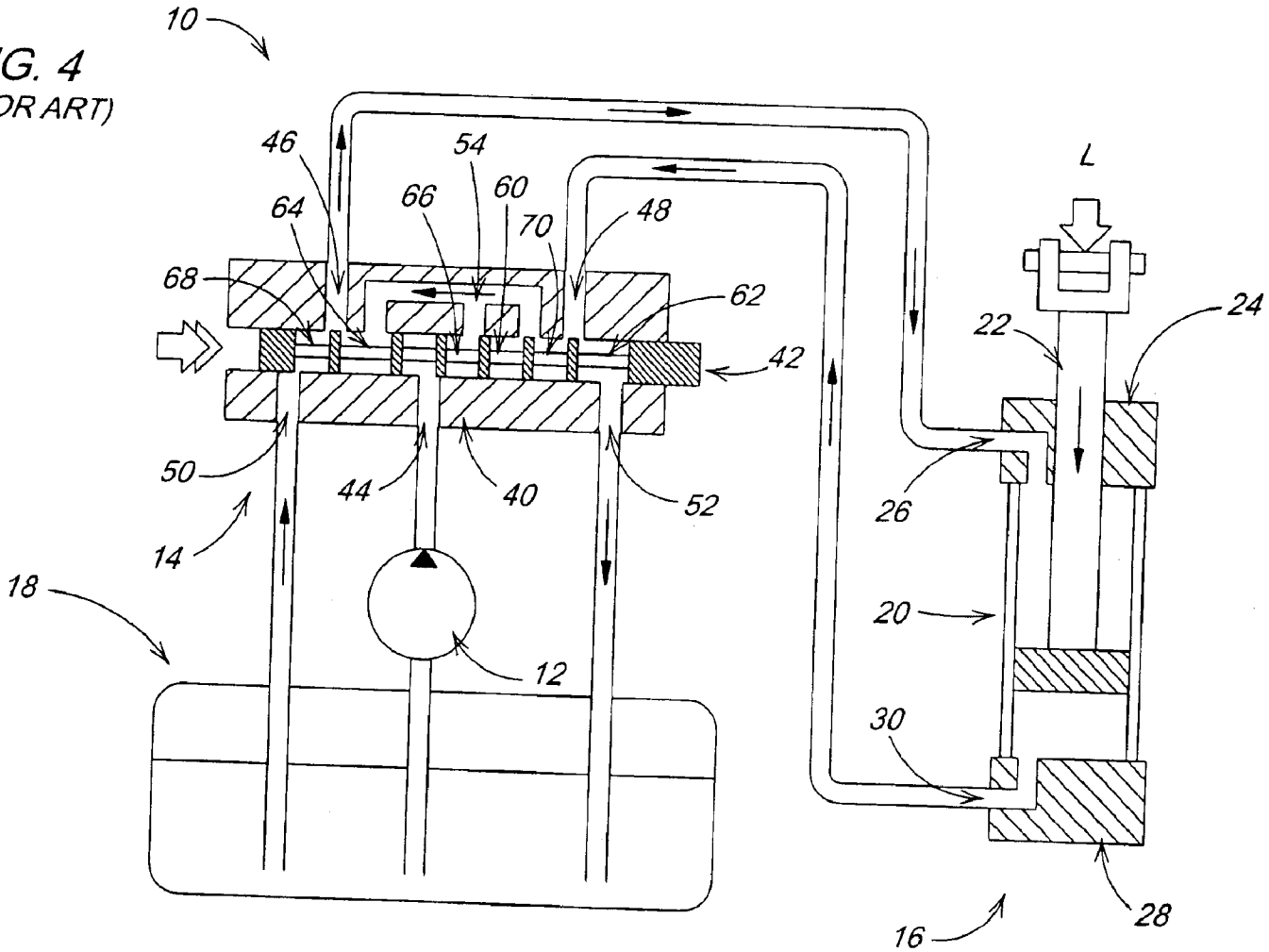
FIG. 4 (PRIOR ART)
FIG. 4 is the schematic representation of the circuit shown in FIG. 1, the circuit shown in "float" condition wherein the hydraulic cylinder is being compressed by an external load.

When the valve spool 42 of the control valve 14 is moved further right from the "lower" position to the "float" position, as shown in FIG. 4, flow from the hydraulic pump 12 is closed-off to the supply passage 54. A second passageway 68 on the valve spool 42 allows hydraulic fluid to flow between the first return port 50 and the first work port 46, creating a flow path for hydraulic fluid to flow between the hydraulic fluid reservoir 18 and the rod end port 26 of the hydraulic cylinder 16. The first passageway 62 on the valve spool 42 continues to allow hydraulic fluid to flow between the second work port 48 and the second return port 52, creating a flow path for hydraulic fluid to flow between the head end port 30 of the hydraulic cylinder 16 and the hydraulic fluid reservoir 18. Additionally, the third passageway 64 on the valve spool 42 allows hydraulic fluid to flow between the supply passage 54 and the first work port 46, while a sixth passageway 70 on the valve spool 42 allows hydraulic fluid to flow between the supply passage 54 and the second work port 48, creating a flow path for hydraulic fluid between the head end port 30 and the rod end port 26 of the hydraulic cylinder 16. The cylinder rod 22 is thereby able to move, or float, relative to the cylinder body 20 in response to external forces acting on the hydraulic cylinder 16.

When the illustrated hydraulic circuit 10 is placed in float condition, and an external force such as a lifted load L acts to compress the cylinder rod 22 towards the cylinder body 20 of the hydraulic cylinder 16, hydraulic fluid is expelled from the head end port 30 and is drawn into the rod end port 26 by the displacement of the cylinder rod 22. During this process, the cylinder rod 22 may be caused to compress so rapidly that an insufficient flow of hydraulic fluid is able to be drawn into the rod end port 26. Under this condition, the hydraulic fluid being drawn into the rod end port 26 is said to cavitate. When this occurs, the rate of cylinder rod 22 compression may become erratic. The resulting erratic movement of the hydraulic cylinder 16, and the load L which it consequently supports, is undesirable.

The present invention improves upon the prior art hydraulic circuit 10 illustrated in FIGS. 1–4 to reduce the occurrence of cavitation during the float condition. More specifically, the present invention modifies the valve spool 42 of the control valve 14 illustrated above to improve the flow of hydraulic fluid between the head end port 30 and the rod end port 26 of the hydraulic cylinder 16 when the control valve 14 is in the float position.

Figure 5:
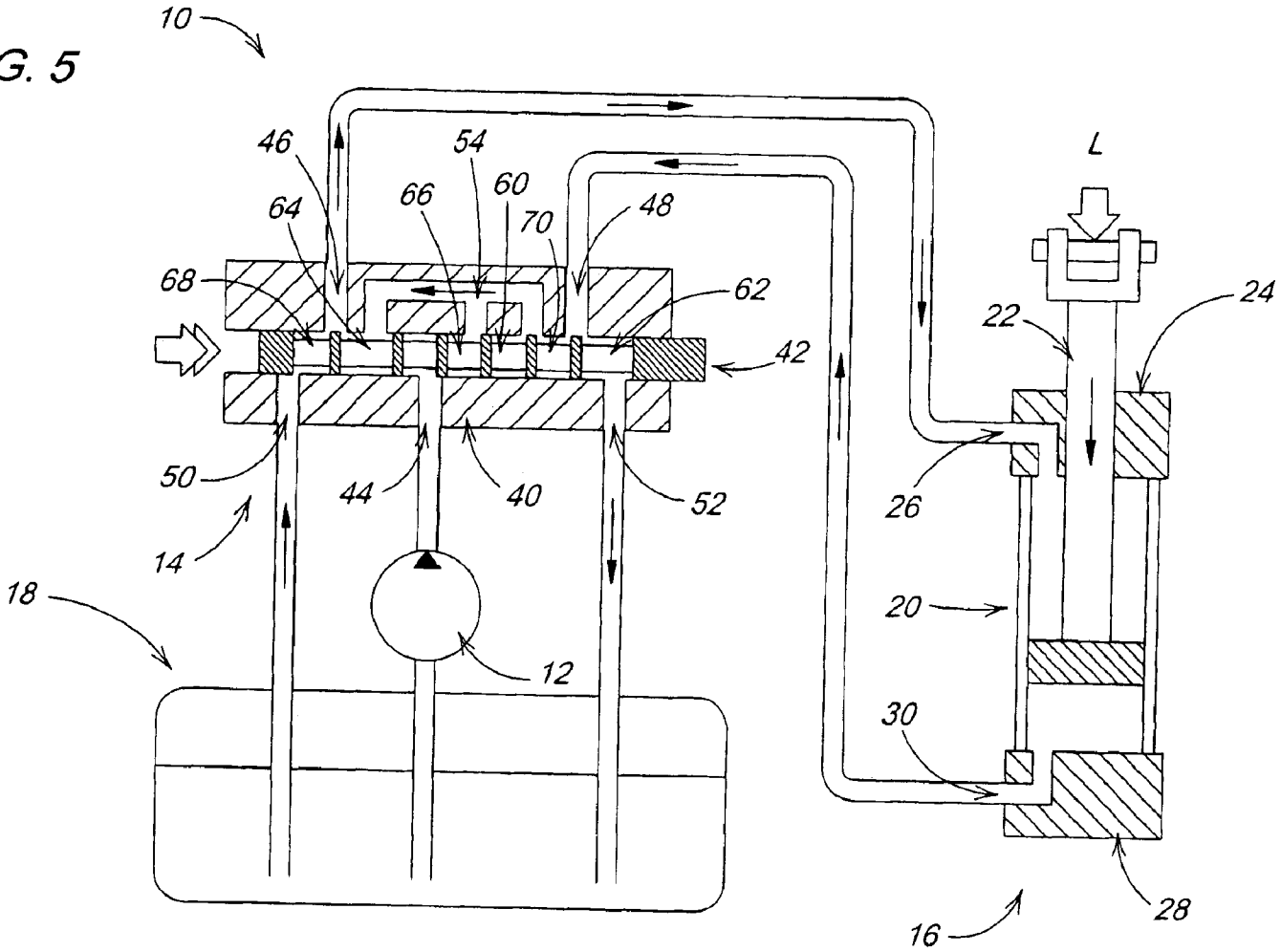
FIG. 5 is a schematic representation of a hydraulic circuit of the first embodiment of the spool-type hydraulic control valve of the present invention. The circuit is shown in "float" condition wherein the hydraulic cylinder is being compressed by an external load.

FIG. 5 illustrates a first embodiment of the present invention. In this embodiment, the flow area of the first passageway 162 on the valve spool 142 is appropriately sized to reduce hydraulic fluid flow from the head end port 30 of the hydraulic cylinder 16 to the hydraulic fluid reservoir 18, such that a sufficient proportion of the hydraulic fluid expelled from the head end port 30 flows through the supply passage 154 of the control valve 14 and back to the rod end port 26 to reduce cavitation when the valve spool 142 is in the "float" position. For example, the first passageway 162 may be sized such that the ratio of flow through the second return port 52 compared with the flow through the second work port 48 is approximately the ratio of the square of the rod cylinder 22 diameter to the square of the cylinder body 20 diameter.

Figure 6:
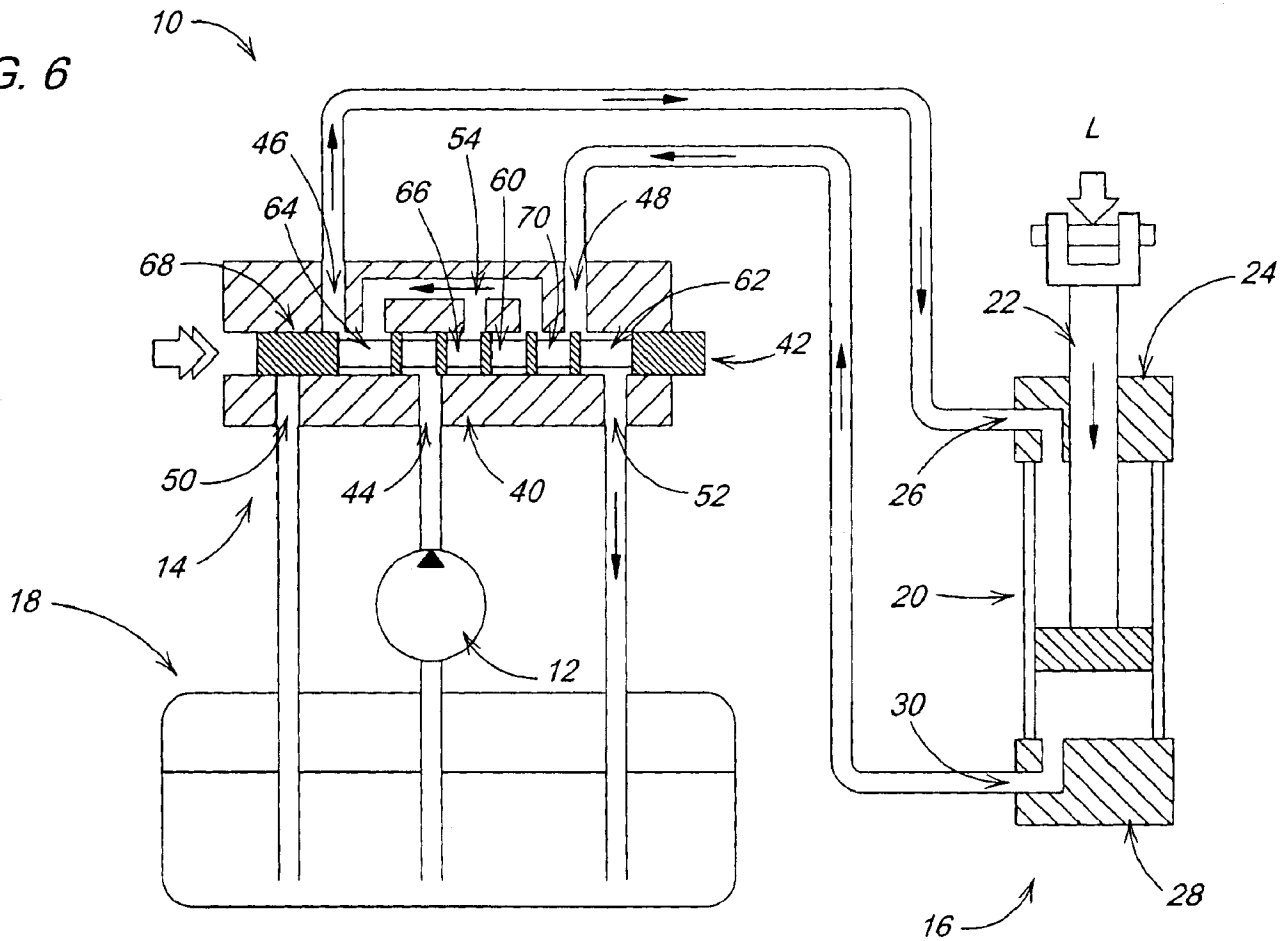
FIG. 6 is a schematic representation of a hydraulic circuit of the second embodiment of the spool-type hydraulic control valve of the present invention. The circuit is shown in "float" condition wherein the hydraulic cylinder is being compressed by an external load.

FIG. 6 illustrates a second embodiment of the present invention. In this embodiment, the second passageway 268 on the valve spool 242 is blocked-off, eliminating the flow path for hydraulic fluid to flow between the hydraulic fluid reservoir 18 and the rod end port 26 of the hydraulic cylinder 16 when the valve spool 242 is in the "float" position.

Additionally, the flow area of first passageway 262 on the valve spool 42 is appropriately sized to reduce hydraulic fluid flow from the head end port 30 of the hydraulic cylinder 16 to the hydraulic fluid reservoir 18, such that a sufficient proportion of the hydraulic fluid expelled from the head end port 30 flows through the supply passage 254 of the control valve 14 and back to the rod end port 26 with minimal cavitation when the valve spool 242 is in the "float" position.

Having described the illustrated embodiment, it will become apparent that various modifications can be made without departing from the scope of the invention as defined in the accompanying claims.

What is claimed is:

1. In a hydraulic directional control valve having a valve body with a slidably positioned valve spool, a first work port, a second work port, a first return port, and a second return port, wherein the first work port and the first return port are fluidly connected by a second passageway on the valve spool when the valve spool is in a float position, wherein second work port and the second return port are fluidly connected by a first passageway on the valve spool when the valve spool is in the float position, and wherein the first work port and second work port are fluidly connected when the valve spool is in the float position, the improvement to the hydraulic directional control valve comprising:

the first passageway on the valve spool being sized such that the flow of hydraulic fluid through the second work port is discouraged, and that flow between the second work port and the first work port is encouraged, when the valve spool is in the float position.

2. The hydraulic directional control valve defined in claim 1, the improvement to the hydraulic directional control valve further comprising:

the second passageway on the valve spool being blocked-off, such that the flow of hydraulic fluid through the first return port is impeded when the valve spool is in the float position.

3. In a hydraulic directional control valve having a valve body with a slidably positioned valve spool, a first work port, a second work port, a first return port, and a second return port, wherein the first work port and the first return port are fluidly connected by a second passageway on the valve spool when the valve spool is in a float position, wherein second work port and the second return port are fluidly connected by a first passageway on the valve spool when the valve spool is in the float position, and wherein the first work port and second work port are fluidly connected when the valve spool is in the float position, the improvement to the hydraulic directional control valve comprising:

the first passageway on the valve spool being sized such that the flow of hydraulic fluid through the second work port is discouraged, and that flow between the second work port and the first work port is encouraged, when the valve spool is in the float position.

the second passageway on the valve spool being blocked-off, such that the flow of hydraulic fluid from through first return port is impeded when the valve spool is in the float position.

4. In a hydraulic circuit comprising a hydraulic directional control valve having a valve body with a slidably positioned valve spool, a first work port, a second work port, a first return port, and a second return port, the hydraulic circuit additionally comprising a hydraulic cylinder having a cylinder body with a slidably positioned cylinder rod, a rod end port fluidly coupled to the first work port, and a head end port fluidly coupled to second work port, wherein the first work port and the first return port are fluidly connected by a second passageway on the valve spool when the valve spool is in a float position, wherein second work port and the second return port are fluidly connected by a first passageway on the valve spool when the valve spool is in the float position, and wherein the first work port and second work port are fluidly connected when the valve spool is in the float position, the improvement to the hydraulic circuit comprising:

the first passageway on the valve spool of the hydraulic directional control valve being sized such that the ratio of flow through the second return port compared with the flow through the second work port is approximately the ratio of the square of the rod cylinder diameter to the square of the cylinder diameter, when the valve spool is in the float position.

5. The hydraulic circuit defined in claim 4, the improvement to the hydraulic circuit comprising:

the second passageway on the valve spool of the hydraulic directional control valve being blocked-off, such that the flow of hydraulic fluid through the first return port is impeded when the valve spool is in the float position.

* * * * *